US006644497B1

(12) United States Patent
Klundt

(10) Patent No.: US 6,644,497 B1
(45) Date of Patent: Nov. 11, 2003

(54) CANDY DISPENSER INCLUDING A TRANSLUCENT TUBE WITH AN INTERNAL SPRING

(75) Inventor: Kalvin Klundt, Lagrange, KY (US)

(73) Assignee: K&A Design, LLC, Louisville, KY (US)

( * ) Notice: Subject to any disclaimer, the term of this patent is extended or adjusted under 35 U.S.C. 154(b) by 52 days.

(21) Appl. No.: 10/096,450

(22) Filed: Mar. 12, 2002

Related U.S. Application Data

(60) Provisional application No. 60/347,700, filed on Jan. 11, 2002.

(51) Int. Cl.[7] ..... A24F 15/04
(52) U.S. Cl. ..... 221/24; 221/75
(58) Field of Search ..... 221/24, 155, 75, 221/82, 232, 268, 289, 226, 217

(56) References Cited

U.S. PATENT DOCUMENTS 4,311,251 A * 1/1982 Sternberg ..... 221/24
4,560,086 A 12/1985 Stol
5,651,475 A 7/1997 Fenton

* cited by examiner

*Primary Examiner*—Kenneth W. Noland
(74) *Attorney, Agent, or Firm*—Sites & Harbison, PLLC; David W. Nagle, Jr.; Brooke J. Egan

(57) ABSTRACT

A candy dispenser comprises a head end and a tail end linked by a substantially translucent tube, a spring being contained in and visible through the tube and extending from the head end of the candy dispenser to the tail end of the candy dispenser. The spring contained within the tube impedes the free fall of candy pellets and functions as a track upon which some candy pellets can ride from one end of the candy dispenser to the other, while some other candy pellets fall through the center of the spring, the falling action and movement of the candy pellets creating a fun and interesting visual image.

16 Claims, 2 Drawing Sheets

CANDY DISPENSER INCLUDING A TRANSLUCENT TUBE WITH AN INTERNAL SPRING

CROSS-REFERENCE TO RELATED APPLICATIONS

The present application claims priority from U.S. Provisional Application Ser. No. 60/347,700 filed Jan. 11, 2002, the entire disclosure of which is incorporated herein by reference.

BACKGROUND OF THE INVENTION

The present invention relates to a candy dispenser comprising a head end and a tail end linked by a substantially translucent tube, a spring being contained in and visible through the tube and extending from the head end of the candy dispenser to the tail end of the candy dispenser. In the preferred embodiment disclosed herein, the spring is a helical spring commonly referred to as a Slinky® (a registered trademark of Poof Products, Inc. of Plymouth, Mich.).

The Slinky® toy was invented in 1945 by Richard James, a naval engineer who was experimenting with tension springs. Since its introduction into the marketplace, various manufacturers have developed toy products and novelties incorporating a spring, such as a Slinky®. Nevertheless, Applicant is aware of no efforts to include such a spring in a candy dispenser as described herein.

It is a paramount object of the present invention to provide a candy dispenser incorporating a spring, resulting in a novelty item that has great consumer appeal especially to children.

This and other objects and advantages of the present invention will become apparent upon a reading of the following description.

SUMMARY OF THE INVENTION

The present invention is a candy dispenser, a novelty item used to store and dispense candy pellets. A preferred candy dispenser in accordance with the present invention comprises a head end and a tail end linked by a substantially translucent tube, a spring being contained in and visible through the tube and extending from the head end of the candy dispenser to the tail end of the candy dispenser. The spring contained within the tube impedes the free fall of candy pellets and functions as a track upon which some candy pellets can ride from one end of the candy dispenser to the other, while some other candy pellets fall through the center of the spring. Because of the preferably translucent nature of the tube, the falling action and movement of the candy pellets creates a fun and interesting visual image. Furthermore, the tube preferably has a cross-sectional inner diameter that is marginally larger than the outer diameter of the spring so the movement of the spring is not inhibited within the tube.

DESCRIPTION OF THE INVENTION

Figure 1:
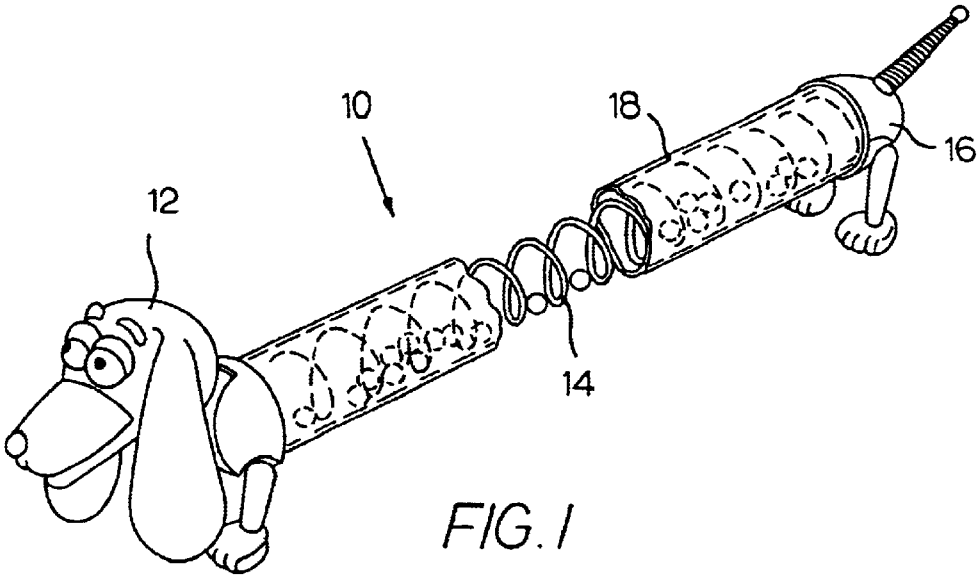
FIG. 1 is a perspective view of a preferred embodiment of a candy dispenser in accordance with the present invention.

FIG. 1 is a perspective view of a preferred candy dispenser (generally indicated by reference numeral 10) made in accordance with the present invention. The candy dispenser 10 comprises a head end 12 and a tail end 16 linked by a tube 18. This tube 18 is the storage vessel for the candy pellets and is secured to the head end 12 and the tail end 16 of the preferred candy dispenser 10 by an adhesive (e.g., glue) or a similar attachment means. The head end 12 and tail end 14 prevent any undesired outflow of the candy pellets from the respective ends of the tube 18. Furthermore, the tube 18 is substantially translucent, the importance of which is described in further detail below. Specifically, the tube 18 is preferably made of a substantially translucent or transparent plastic. Nevertheless, it is contemplated that the tube 18 could also be made of other materials (e.g., glass) without departing from the spirit and scope of the present invention.

In the preferred embodiment shown in the Figures, the head end 12 and tail end 16 of the candy dispenser 10 are formed in the images of the head and tail of a dog. Of course, the head end 12 and tail end 16 are designed to be attractive to children and could take multiple forms, including characters, shapes, persons and animals, without departing from the spirit and scope of the present invention.

Referring still to FIG. 1, a spring 14 is contained within the tube 18 of the candy dispenser 10 and extends substantially the length of the tube 18. Although not clearly shown in the Figures, one distal end of the spring 14 is secured to an interior surface of the tube 18 near the head end 12 of the candy dispenser 10. Similarly, the opposite distal end of the spring 14 is secured to an interior surface of the tube 18 near the tail end 16 of the candy dispenser 10. Alternatively, the respective distal ends of the spring 14 could be secured to the head end 12 and the tail end 16 themselves without departing from the spirit and scope of the present invention.

In this preferred embodiment, the spring 14 is a plastic helical spring commonly referred to as a Slinky® (a registered trademark of Poof Products, Inc. of Plymouth, Mich.). Of course, a metal helical spring could also be incorporated into the candy dispenser 10 without departing from the spirit and scope of the present invention. Furthermore, the spring 14 may have various cross-sectional geometries, such as a rectangle, square or heart.

Figure 2:
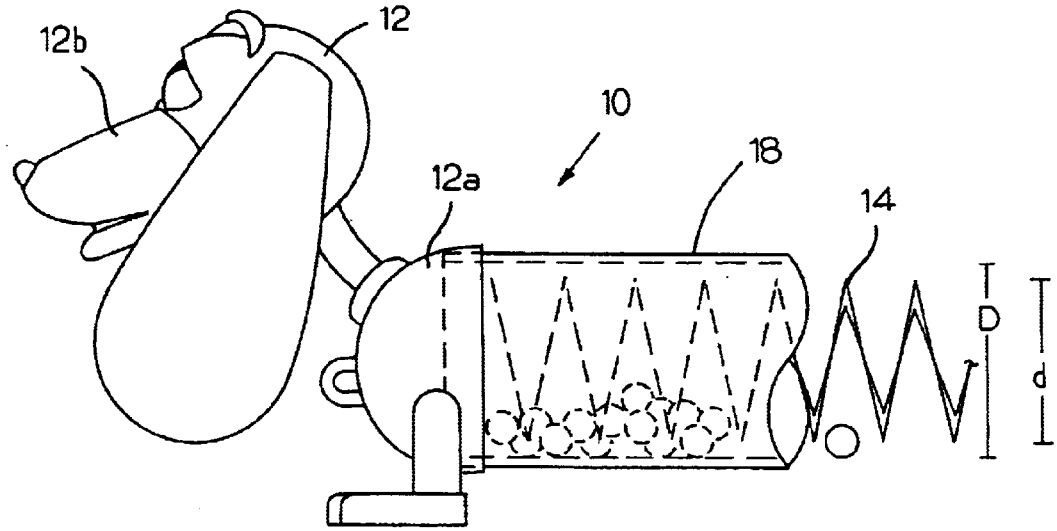
FIG. 2 is a partial side view of the preferred candy dispenser of FIG. 1.

As best shown in the partial side view of the FIG. 2, the tube 18 preferably has a circular cross-section with an inner diameter D that is marginally larger than the outer diameter d of the spring 14, effectuating a close fit between the tube 18 and the spring 14. However, it is preferred that contact between the individual coils of the spring 14 and the inner walls of the tube 18 be eliminated or substantially minimized so as not to inhibit movement of the spring 14, as will be described in further detail below. Furthermore, the tube 18 of the present invention could also have an alternate cross-sectional geometry, such as rectangular or heart-shaped, without departing from the spirit and scope of the invention.

The tube 18 is the storage vessel for the candy pellets to be dispensed. However, the tube 18 is not intended to be entirely filled with candy pellets. Rather, the volume of candy pellets contained in the tube 18 is substantially smaller than the volume capacity of the tube 18. Therefore, as the tube 18 is manipulated by an individual, the candy pellets shift from one end of the tube 18 to the other end under the force of gravity. For example, if the candy dispenser 10 is manipulated to a substantially vertical position with the head end 12 pointing downwardly, the candy pellets would fall toward the head end 12 of the dispenser 10. However, the spring 14 contained within the tube 18 partially impedes the free fall of the candy pellets. Indeed, the spring 14 functions as a track upon which candy pellets can ride from one end of the candy dispenser 10 to the other. Of course, some candy pellets may also fall through the center of the spring 14. In any event, because of the preferably translucent nature of the tube 18, the falling action and movement of the candy pellets creates a fun and interesting visual image.

Furthermore, because it is preferred that the spring 14 is secured only at its respective distal ends, a substantial portion of the spring 14 is unsupported. And, as mentioned above, the tube 18 has a cross-section with an inner diameter D that is marginally larger than the outer diameter d of the spring 14, thus eliminating or substantially minimizing contact with the walls of the tube 18. As such, through appropriate manipulation of the candy dispenser, a "bouncing" movement of the spring can be achieved.

Figure 3:
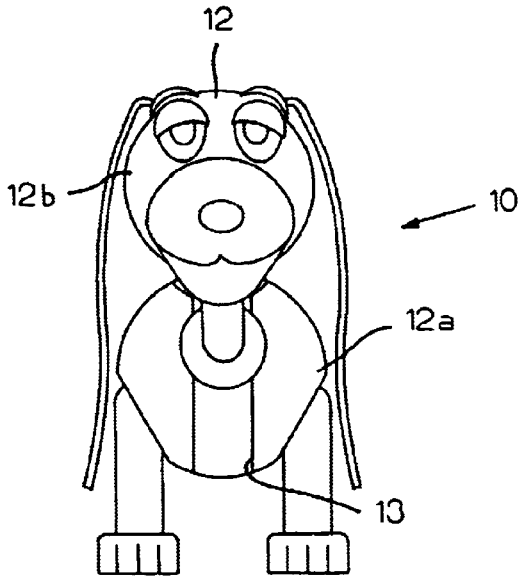
FIG. 3 is a front view of the preferred candy dispenser of FIG. 1.
Figure 4:
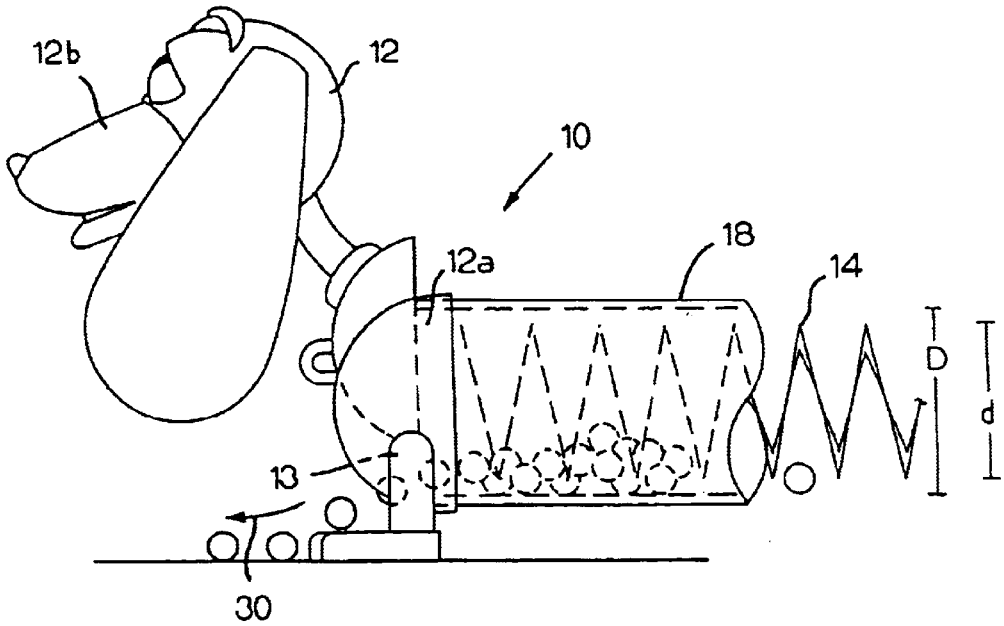
FIG. 4 is a partial side view of the preferred candy dispenser of FIG. 1 with the head end in an open position for dispensing candy pellets.

FIG. 3 is a front view of the preferred candy dispenser, depicting the head end 12 of the dispenser 10. The head end 12 is comprised a two portions 12*a*, 12*b*. The first portion 12*a* defines an opening 13 into the interior of the tube 18, said opening being adapted to receive the second portion 12*b* of the head end 12. Thus, in a closed position, the second portion 12*b* of the head end 12 is received in and covers the opening 13, preventing candy pellets from exiting the tube 18. By sliding the second portion 12*b* of the head end 12 upwardly to an open position, as indicted in FIG. 4, the opening 13 defined into the interior of the tube 18 is exposed, and candy pellets may be dispensed from the candy dispenser 10, as indicated by arrow 30. Indeed, for purposes of this description, the "head end" is considered to be the end that allows for dispensing of the candy pellets. Although the simple construction illustrated in FIGS. 3–4 and described above is preferred for accessing and dispensing the candy pellets, other dispensing means may also be employed without departing from the spirit and scope of the present invention.

It will be obvious to those skilled in the art that other modifications may be made to the invention as described herein without departing from the spirit and scope of the present invention.

What is claimed is:

1. A candy dispenser for storing and dispensing candy pellets, comprising:

a substantially translucent tube adapted to store a volume of said pellets;

a head end secured to a first end of said tube to prevent an undesired outflow of said pellets from the first end of said tube;

a tail end secured to a second end of said tube to prevent an undesired outflow of said pellets from the second end of said tube; and a spring contained within said tube and functioning as a track upon which some of said pellets can ride between said head end and said tail end.

2. A candy dispenser as recited in claim 1, wherein a first distal end of said spring is secured to said tube near the first end thereof, and a second distal end of said spring is secured to said tube near the second end thereof.

3. A candy dispenser as recited in claim 2, wherein said tube has a cross-sectional inner diameter that is marginally larger than the outer diameter of said spring, thereby not inhibiting the movement of said spring contained within the tube.

4. A candy dispenser as recited in claim 1, wherein a first distal end of said spring is secured to said head end and a second distal end of said spring is secured to said tail end.

5. A candy dispenser as recited in claim 4, wherein said tube has a cross-sectional inner diameter that is marginally larger than the outer diameter of said spring, thereby not inhibiting the movement of said spring contained within the tube.

6. A candy dispenser as recited in claim 1, wherein the volume of said pellets stored in said tube is substantially smaller than the volume capacity of said tube.

7. A candy dispenser as recited in claim 1, wherein said head end and said tail end are in the form of characters, shapes, persons, or animals.

8. A candy dispenser as recited in claim 1, wherein said head end defines an opening into the interior of the tube such that the pellets can be dispensed from said tube.

9. A candy dispenser as recited in claim 8, wherein said head end is comprised of a first portion, which defines the opening into the interior of the tube, and a second portion adapted to selectively cover the opening into the interior of the tube.

10. A candy dispenser for storing and dispensing candy pellets, comprising:

a substantially translucent tube adapted to hold said pellets;

a head end secured to a first end of said tube to prevent an undesired outflow of said pellets from the first end, said head end including a first portion defining an opening into the interior of said tube and a second portion adapted to selectively cover the opening into the interior of said tube;

a tail end secured to a second end of said tube to prevent an undesired outflow of said pellets from the second end; and a spring contained within said tube and functioning as a track upon which some of said pellets can ride between said head end and said tail end.

11. A candy dispenser as recited in claim 10, wherein a first distal end of said spring is secured to said tube near the first end thereof, and a second distal end of said spring is secured to said tube near the second end thereof.

12. A candy dispenser as recited in claim 11, wherein said tube has a cross-sectional inner diameter that is marginally larger than the outer diameter of said spring, thereby not inhibiting the movement of said spring contained within the tube.

13. A candy dispenser as recited in claim 10, wherein a first distal end of said spring is secured to said head end and a second distal end of said spring is secured to said tail end.

14. A candy dispenser as recited in claim 13, wherein said tube has a cross-sectional inner diameter that is marginally larger than the outer diameter of said spring, thereby inhibiting the movement of said spring contained within the tube.

15. A candy dispenser as recited in claim 10, wherein the volume of said pellets stored in said tube is substantially smaller than the volume capacity of said tube.

16. The candy dispenser as recited in claim 10, wherein said head end and said tail end are in the form of characters, shapes, persons, or animals.

* * * * *